US006641024B2

(12) United States Patent
Sato et al.

(10) Patent No.: US 6,641,024 B2
(45) Date of Patent: Nov. 4, 2003

(54) STAPLING DEVICE

(75) Inventors: Kouki Sato, Ibaragi-ken (JP); Toshiro Fukasawa, Yamanashi-ken (JP); Koichi Kitta, Enzan (JP)

(73) Assignee: Nisca Corporation, Yamanashi-ken (JP)

( * ) Notice: Subject to any disclaimer, the term of this patent is extended or adjusted under 35 U.S.C. 154(b) by 29 days.

(21) Appl. No.: 09/775,808

(22) Filed: Feb. 5, 2001

(65) Prior Publication Data

US 2001/0011667 A1 Aug. 9, 2001

(30) Foreign Application Priority Data

Feb. 8, 2000 (JP) ..... 2000-035622
Feb. 8, 2000 (JP) ..... 2000-035624
Feb. 8, 2000 (JP) ..... 2000-036523

(51) Int. Cl.[7] ..... B25C 7/00
(52) U.S. Cl. ..... 227/155; 227/111; 227/110
(58) Field of Search ..... 227/155, 111, 227/110

(56) References Cited

U.S. PATENT DOCUMENTS 5,005,751 A * 4/1991 Radtke et al. ..... 227/111
5,029,831 A * 7/1991 Green ..... 227/101
5,181,643 A * 1/1993 Radtke ..... 227/110
5,460,314 A * 10/1995 Udagawa ..... 227/131
5,584,471 A * 12/1996 Muck et al. ..... 227/123
5,639,078 A * 6/1997 Mandel et al. ..... 270/58.12
5,662,318 A 9/1997 Harada et al.
5,772,197 A * 6/1998 Aoki et al. ..... 270/58.08
5,799,935 A 9/1998 Yamanushi et al.
5,806,750 A 9/1998 Yamanushi et al.
H1842 H * 3/2000 Tontarski ..... 227/100
6,223,965 B1 * 5/2001 Nakatsuka ..... 227/111

FOREIGN PATENT DOCUMENTS

JP 6-63342 9/1994
JP 8-108378 4/1996

* cited by examiner

*Primary Examiner*—Stephen F. Gerrity
*Assistant Examiner*—Louis Tran
(74) *Attorney, Agent, or Firm*—Kanesaka & Takeuchi

(57) ABSTRACT

A stapling device for automatically binding a set of sheets is formed of a needle driving unit for driving a needle in the set of the sheets; a bending unit for bending the driven needle; two pairs of front and rear guide shafts for supporting the needle driving unit and the bending unit and guiding movements of these units in a sheet width direction; and moving shafts for moving these units along the guide shafts in the sheet width direction. By disposing each moving shaft between the front and rear guide shafts, each unit can be moved in the sheet width direction stably and smoothly, and the entire device can be structured small. Also, in at least one of the units, a small space is formed for a moving mechanism for at least one of needle driving device and bending device in a sheet thickness direction, to thereby achieve a further miniaturization of the entire device.

8 Claims, 9 Drawing Sheets

STAPLING DEVICE

BACKGROUND OF THE INVENTION AND RELATED ART STATEMENT

The present invention relates to a combination of a needle driving unit with needle driving means and a bending unit with bending means for bending the needle in order to bind a set of sheets stacked together.

In particular, the present invention relates to a stapling device in which the needle driving unit and the bending unit are stably moved in a sheet width direction of the set of the sheets to carry out a stapling process at any position, and a needle driving mechanism or bending mechanism in these units is improved to miniaturize the entire device.

Heretofore, various stapling devices for automatically stapling a set of sheets to bind the same have been proposed. In case this kind of stapling device is adopted to an image forming apparatus, such as a printer or a copier, it is structured that sheets ejected from an image forming section are stacked into a set or bundle, and a needle is automatically driven to a predetermined position of the set of the sheets to operate the binding process.

In the stapling device proposed in recent years, in order to provide the stapling process not only to a corner portion of the set of the sheets or a sheet side edge portion, but also to a center portion of the set of the sheets or any plural positions thereof, there has been proposed a stapling device in which a needle driving unit and a needle bending unit are separated on both sides of a sheet set passageway.

For example, the stapling devices in this kind have been disclosed in U.S. Pat. No. 5,806,750 corresponding to Japanese Patent Publication (KOKAI) No. 9-136302; U.S. Pat. No. 5,799,935 corresponding to Japanese Patent Publication (KOKAI) No. 9-136303; U.S. Pat. No. 5,662,318 corresponding to Japanese Patent Publication (KOKAI) NO. 8-108377; and Japanese Utility Model Publication (KOKAI) No. 6-63342.

In these stapling devices described above, especially, in a stapling device disclosed in U.S. Pat. No. 5,806,750 or a stapling device disclosed in U.S. Pat. No. 5,799,935, as shown in FIG. 12, a stapler S includes a needle driving unit 100 which drives a needle into a set of sheets, and a bending unit 101 for inwardly bending distal ends of the needle driven in the set of the sheets to thereby staple the same, and has a mechanism such that the set of the sheets sent between the needle driving unit 100 and the bending unit 101 is clamped between both the units 100 and 101 by moving both or one of the needle driving unit 100 and the bending unit 101, to thereby drive the needle into the set of the sheets.

Here, in order to move the needle driving unit 100 and the bending unit 101 in a sheet width direction, the aforementioned stapler S includes a pair of guide shafts 102F and 102R provided at the front and rear sides of the needle driving unit 100 in a lower side, and a pair of guide shafts 103F and 103R provided at the front and rear sides of the bending unit 101 in an upper side. Also, at the rear side of the rear guide shafts 102R and 103R, there are disposed moving shafts 104 and 105 for transmitting forces to move the needle driving unit 100 and the bending unit 101 in a sheet width direction from outside thereof.

Also, in other structures disclosed in other patent publications described above, similarly, at the rear sides of the guide shafts, moving forces for moving the needle driving unit and the bending unit in the sheet width direction are applied from outside.

Therefore, in the stapling devices disclosed in the patent publications described above, since the moving force is applied to a side end outside each unit, in case of moving the unit along the guide shaft, a moving force in the direction of inclining the unit with respect to the guide shaft always works, so that an unnecessary resistance force may work between the unit and the guide shaft. Accordingly, a movement in the sheet width direction may not be made stably and smoothly.

Also, in the stapling device described above, since the moving shafts for moving the units in the sheet width direction are disposed outside the units and the guide shafts for guiding the movements of the units, a large space is required for installing a driving transmission mechanism or the like for driving the moving shafts, so that the miniaturization of the entire device can not be fully achieved.

Further, in the conventional stapling device, in case, for example, needle bending means in the unit is moved in the sheet thickness direction, a vertical movement of the needle bending means is made by a cam through a lever, and a large space for the cam, the lever or the like is required between the cam and the needle bending means. Especially, in case a stapling process is carried out for a set of sheets ranged from a small number of sheets to a large number of sheets, an area for vertical movement of the bending means must be enlarged. Thus, an interlocking movement mechanism formed of the cam and a lever mechanism has to be complicated, or the lever or the cam itself must be enlarged, so that a space for disposing or arranging the interlocking mechanism, such as the lever, must be enlarged between the cam and the bending means, resulting in further increasing a size of the entire device.

Thus, in the recent progress of further miniaturizing the image forming apparatus to which the stapling device is applied, the aforementioned stapling device can not respond to the demand of miniaturizing the stapling device.

Accordingly, an object of the present invention is to provide a stapling device in which a needle driving unit and a needle bending unit can be moved stably and smoothly in case these units are moved in a sheet width direction, and guide shafts and moving shafts as mechanisms for moving these units are disposed rationally, to thereby achieve a miniaturization of the entire device.

Another object of the invention is to provide a stapling device as stated above, in which a space for moving the needle bending means or the like in the sheet thickness direction is reduced as small as possible, to thereby achieve the miniaturization of the entire device.

A further object of the invention is to provide a stapling device as stated above, which can be applied to a small size image processing apparatus, and in this case, the set of the sheets can be securely stapled at a stapling position.

Further objects and advantages of the invention will be apparent from the following description of the invention.

SUMMARY OF THE INVENTION

To achieve the aforementioned objects, the present invention provides a stapling device, comprising: a needle driving unit for driving a needle into a set of sheets; a bending unit for bending the needle driven into the set of the sheets; two pairs of front and rear guide shafts for respectively supporting the needle driving unit and the bending unit and guiding movements of these units in a sheet width direction; and moving shafts for moving the needle driving unit and the bending unit along the guide shafts in the sheet width direction, wherein the respective moving shafts are disposed between the front and rear guide shafts. Therefore, movements of the respective units in the sheet width direction can be operated stably and smoothly, and since the moving shafts are disposed between the front and rear guide shafts, the entire device can be structured compact.

Also, in the stapling device as stated above, one of the front and rear guide shafts disposed in each of the needle driving unit and the bending unit is also used as a driving shaft for a needle driving operation or a bending operation. Accordingly, it is not necessary to provide an additional moving mechanism, to thereby achieve the further miniaturization of the device.

Further, between the needle driving unit and the bending unit, there are disposed sheet path guide members extending between the front and rear guide shafts, and the sheet path guide members are attached to spring members wound around the guide shaft. The spring member is expanded or contracted in accordance with the movement of the needle driving unit and the bending unit along the guide shafts, and the sheet path guide member moves in an axial direction of the guide shafts by the expansion or contraction of the spring member. Therefore, even if the sheet in the set of the sheets is curled, the set of the sheets can be guided by the sheet path guide members, so that the set of the sheets can be securely stapled.

Also, in at least one of the needle driving unit and the bending unit, there are disposed a movable frame for supporting at least one of needle driving means and bending means; a base frame for supporting the movable frame to be movable in a sheet thickness direction; and cam means for moving the movable frame in the sheet thickness direction, wherein the cam means is disposed in one of the base frame and the movable frame. Accordingly, a space for a moving mechanism for moving the needle bending means or the like in the sheet thickness direction is reduced as small as possible, to thereby achieve the miniaturization of the entire device.

DETAILED DESCRIPTION OF PREFERRED EMBODIMENTS

Figure 1:
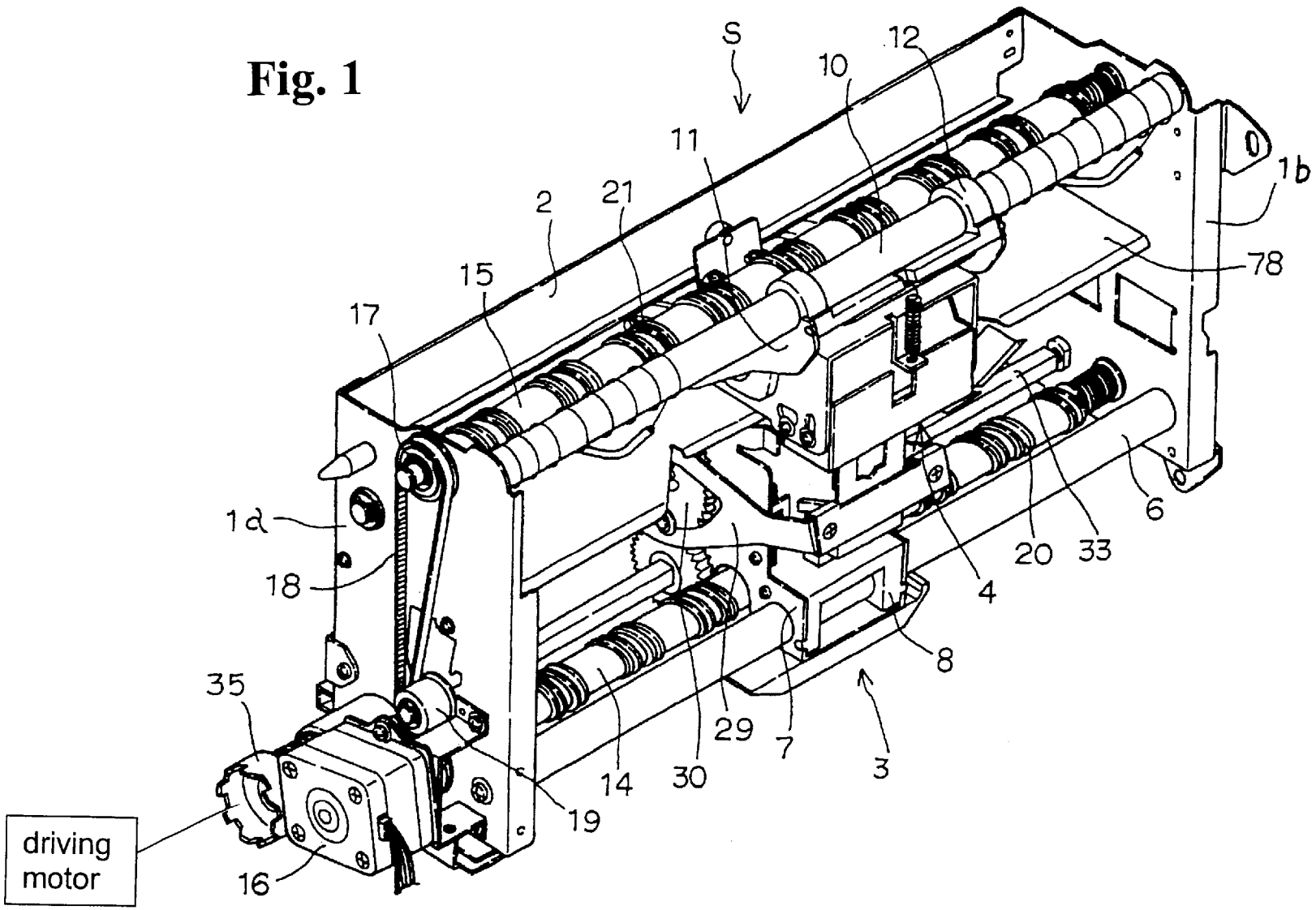
FIG. 1 is a schematic view of an entire structure of a stapling device or stapler according to the present invention.
Figure 2:
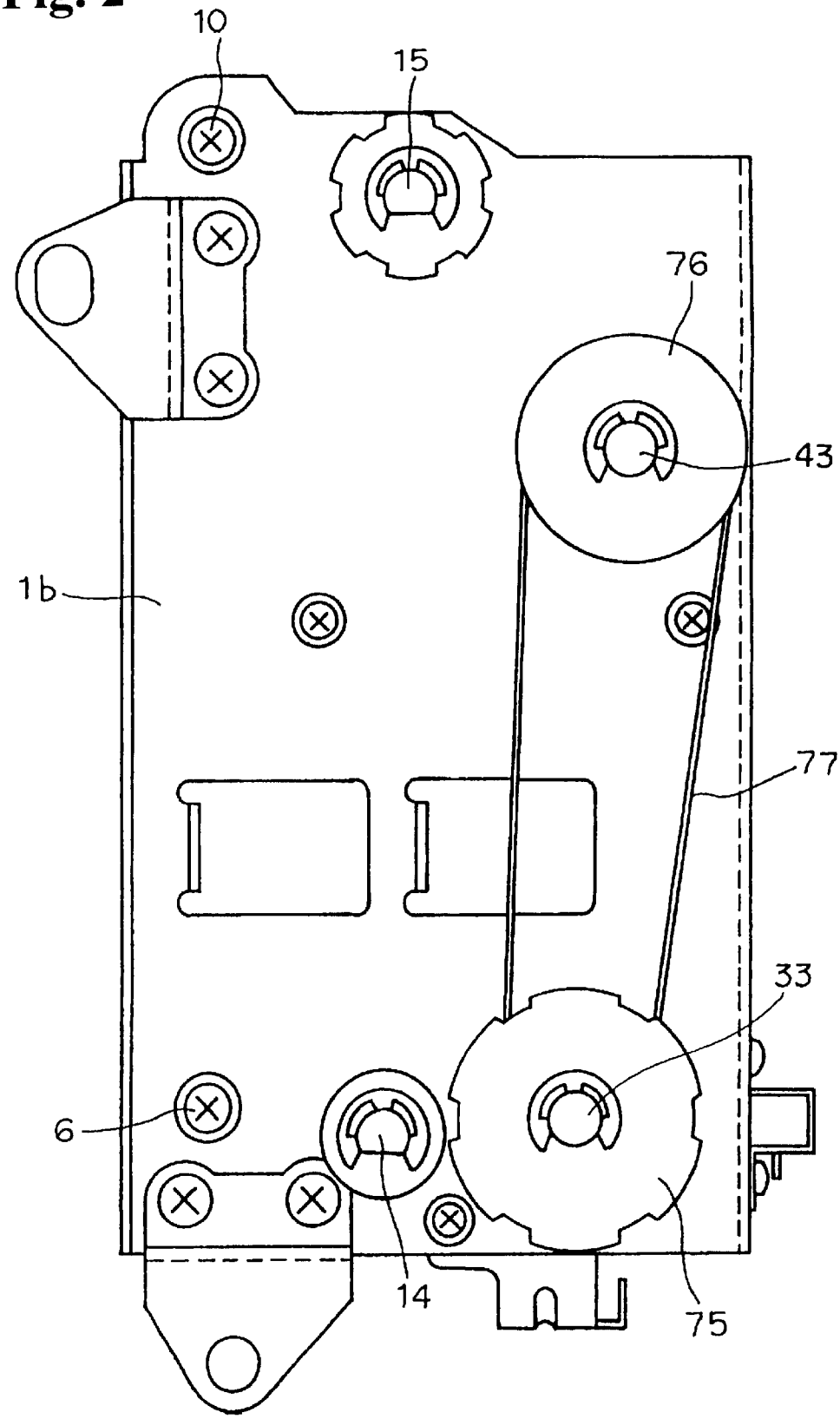
FIG. 2 is a side view of the stapler showing an arrangement of guide shafts and screw rods as moving shafts.

Hereunder, embodiments of a stapling device according to the present invention will be explained with reference to the attached drawings. FIG. 1 is a schematic view of an entire structure of a stapling device according to the present invention, and FIG. 2 is a side view of the stapling device showing a positional relationship of guide shafts or the like. Also, FIG. 3 is a structural view of a needle driving unit and a bending unit disposed opposite to the needle driving unit, and FIG. 4 is an exploded perspective view showing a structure of the bending unit.

As shown in FIG. 1 and FIG. 2, a stapling device (stapler S) of the embodiment has a frame structure by a pair of left and right side plates 1*a* and 1*b*, and a rear plate 2 connecting the upper rear sides of the side plates 1*a* and 1*b*. Also, as shown in FIG. 1 and FIG. 3, the stapler S includes a head unit 3 as a needle driving unit, and an anvil unit 4 as a bending unit, divided into two portions in a vertical direction. The head unit 3 located at a lower side is structured to separate one staple, i.e. staple needle, from a staple needle band in which a large number of staple needles are connected in a band form. Namely, the head unit 3 is structured to separate one staple needle from the band form, and to drive the staple needle into a set of the sheets sent between the head unit 3 and the anvil unit 4 such that the needle passes through the set of the sheets in a thickness direction. On the other hand, the anvil unit 4 disposed opposite to the head unit 3 is structured to receive both leg portions of the staple needle driven into the set of the sheets, and the anvil unit 4 urges both ends of the staple needle to be bent inwardly to staple the set of the sheets finally.

The head unit 3 and the anvil unit 4 are supported to be movable along a direction (sheet width direction) perpendicularly to a feeding or transferring direction of the set of the sheets through guide mechanisms thereof under a condition that the head unit 3 and the anvil unit 4 are synchronous to each other. Also, the head unit 3 and the anvil unit 4 are structured to move integrally by a moving mechanism, described later, under a condition that a relative positional relationship between the head unit 3 and the anvil unit 4 is maintained to be constant.

Figure 3:
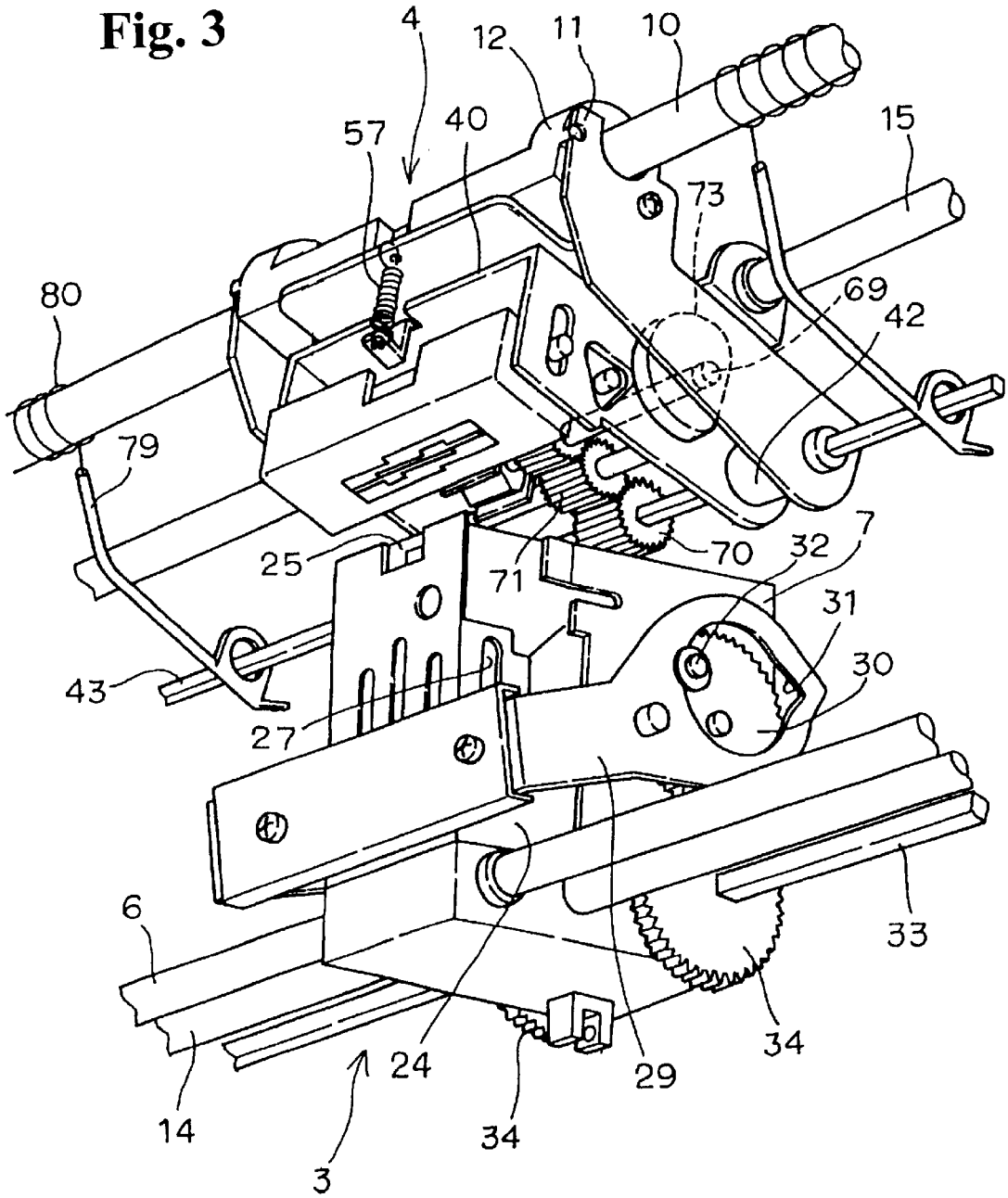
FIG. 3 is a structural view of a head unit and an anvil unit disposed opposite to the head unit.
Figure 4:
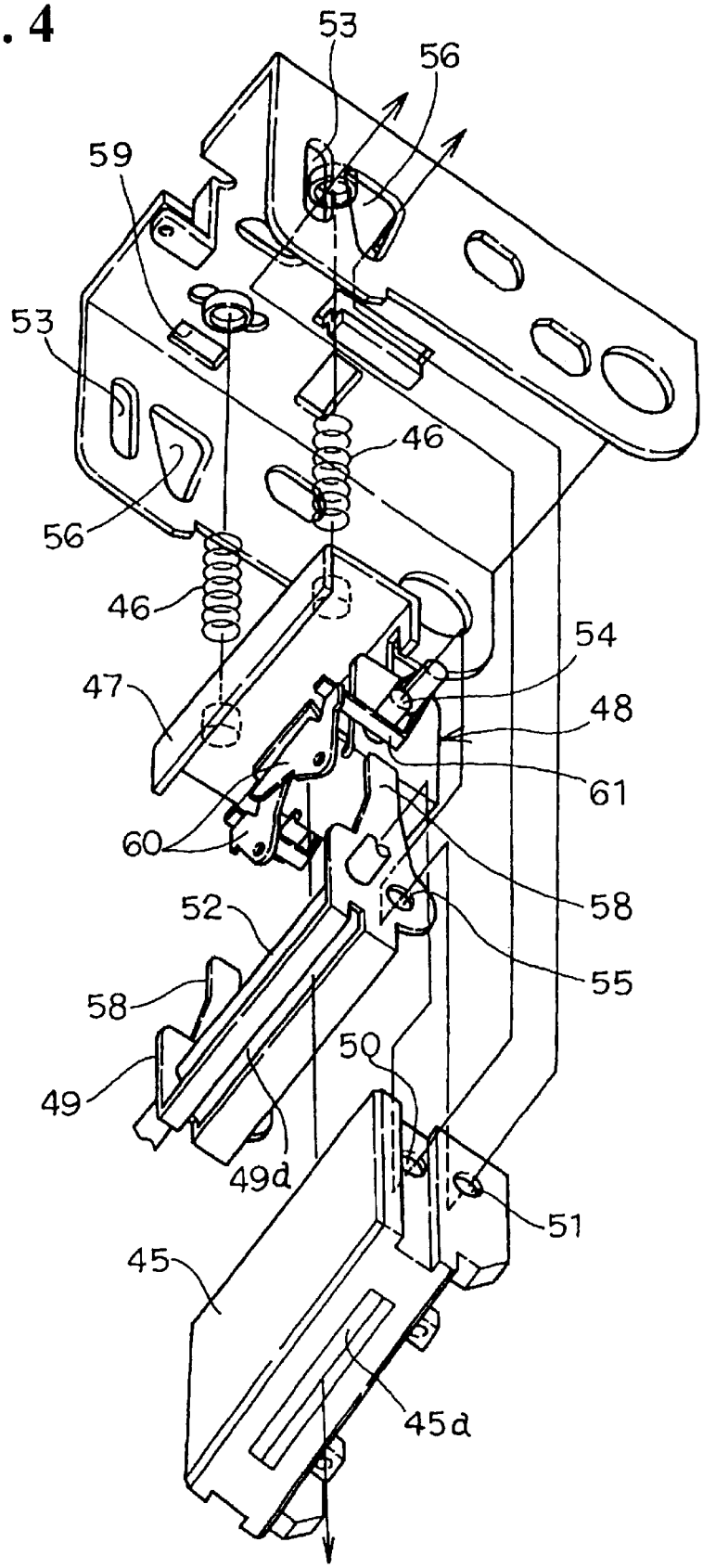
FIG. 4 is an exploded perspective view showing a structure of the anvil unit.
Figure 5:
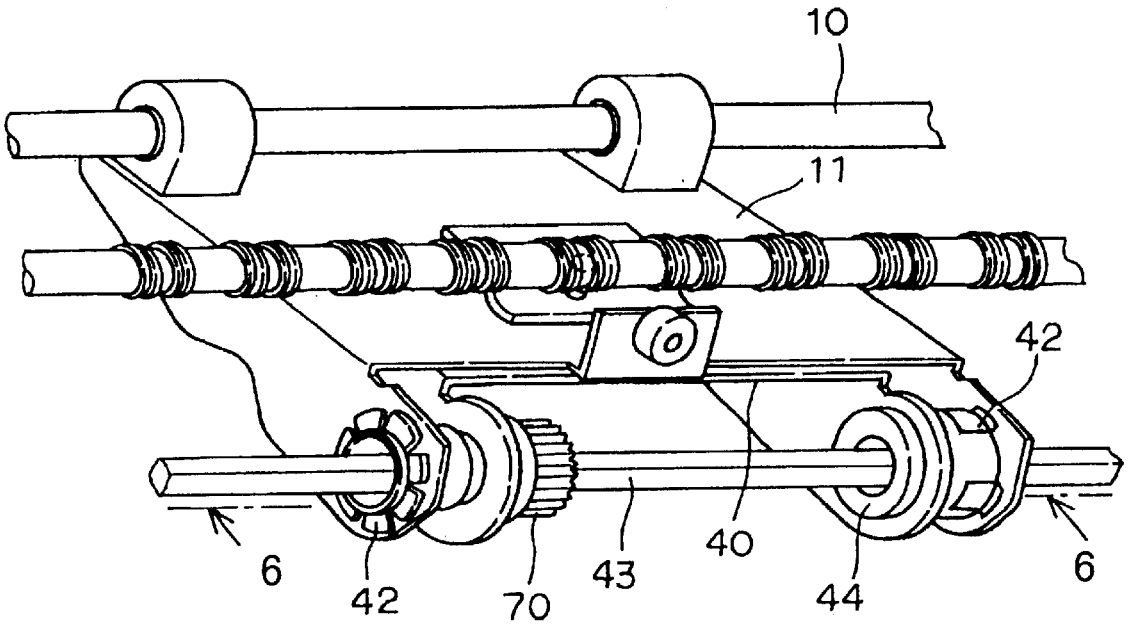
FIG. 5 is a perspective view showing a structure of a center portion of the anvil unit.
Figure 6:
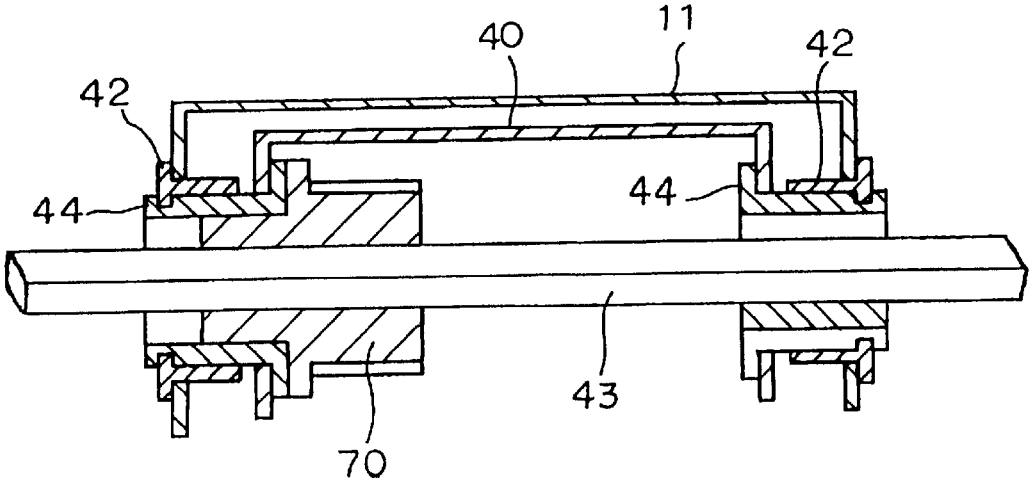
FIG. 6 is a cross sectional view taken along line 6—6 in FIG. 5.

As shown in FIG. 1 through FIG. 3, a guide mechanism for the head unit 3 is formed of a pair of front and rear guide shafts 6 and 33 extending between the left and right side plates 1*a* and 1*b*. The front guide shaft 6 is a shaft having a circular shape in section, and the rear guide shaft 33 is a shaft having a rectangular shape in section. Then, the front guide shaft 6 and the rear guide shaft 33 are disposed parallel to each other. Also, a lower section of the head unit 3 is provided with a guide block 8 which is integral with a box frame 7, and the guide shaft 6 is allowed to pass through guide holes bored in the guide block 8. Also, driving gears 34 disposed at both sides of the box frame 7 are fitted with the guide shaft 33 to be slidably movable. Accordingly, the head unit 3 is supported to be movable with respect to the guide shafts 6 and 33. Incidentally, the box frame 7 itself is loosely fitted with the guide shaft 33.

On the other hand, similarly to the guide mechanism for the head unit 3, a guide mechanism for the anvil unit 4 is also formed of a pair of guide shafts 10 and 43 extending between the pair of the left and right side plates 1*a* and 1*b*. The guide shafts 10 and 43 are disposed parallel to each other as in the guide mechanism for the head unit 3, and the guide shafts 10 and 43 are arranged to have a positional relationship in which the guide shafts 10 and 43 are opposed to the guide shafts 6 and 33. Incidentally, the front guide shaft 10 is a shaft having a circular shape in section, and the rear guide shaft 43 is a shaft having a rectangular shape in section. In an upper front side of the anvil unit 4, there is disposed a guide block 12 integrally attached to a fixed frame 11, and the guide shaft 10 is allowed to pass through guide holes bored in the guide block 12. Also, in a rear end side of the anvil unit 4, a movable frame 40 is axially supported at the fixed frame 11 to be swingable, and cylindrical collars 42 and 44 formed at rear ends of the fixed frame 11 and the movable frame 40 are loosely fitted with the rear guide shaft 43. Also, a driving gear 70 fitted in the collar 44 is fitted slidably with the guide shaft 43.

The head unit 3 and the anvil unit 4 are moved by a moving mechanism. The moving mechanism includes a screw rod 14 at a side of the head unit 3 to be disposed at an intermediate portion between the guide shafts 6 and 33; a screw rod 15 at a side of the anvil unit 4 to be disposed at an intermediate portion between the guide shafts 10 and 43; and a motor 16 for driving the screw rods 14 and 15. These screw rods 14 and 15 are disposed parallel to the respective guide shafts 6, 33, 10 and 43, and both ends of the screw rods 14 and 15 are axially supported by the left and right side plates 1*a* and 1*b* to be freely rotatable. At an outside of the side plate 1*a*, the motor 16 is attached to the screw rod 14 at the side of the head unit 3, and the motor 16 directly rotates the screw rod 14. Also, through a timing belt 18, a driving force of the motor 16 is transmitted to a driven gear 17 fixed to a projected end portion of the screw rod 15 at the side of the anvil unit 4, so that both the screw rods 14 and 15 are rotated at the same speed in the same direction.

Incidentally, a tension roller 19 elastically abuts against the timing belt 18. Also, ball screw threads 20 and 21 are respectively formed on the outer peripheral surfaces of the screw rods 14 and 15. Engaging pins, not shown, projecting from the head unit 3 and the anvil unit 4 are respectively engaged with the ball screw threads 20 and 21, so that it is possible to slidably move the respective units 3 and 4 in accordance with the rotations of the screw rods 14 and 15.

As described above, since the screw rod 14 of the head unit 3 and the screw rod 15 of the anvil unit 4 are respectively disposed at the intermediate portion between the guide shafts 6 and 33 and at the intermediate portion between the guide shafts 10 and 43, it is possible to miniaturize the entire device as compared with the conventional one. Also, in case the head unit 3 and the anvil unit 4 are driven by the rotations of the screw rods 14 and 15, the front and rear sides of the respective units 3 and 4 are supported by the guide shafts 6, 33, 10 and 43, and the screw rods 14 and 15 are engaged with the respective units 3 and 4 in the vicinity of substantially central portions in the front and rear directions of the respective units 3 and 4, so that inclinations of these units 3 and 4 are little, and these units 3 and 4 can be moved in the stable posture.

Further, as shown in FIG. 1 through FIG. 3, since the guides shafts 6 and 33 and the screw rod 14 at the side of the head unit 3, and the guide shafts 10 and 43 and the screw rod 15 at the side of the anvil unit 4, are disposed at positions facing each other with the units therebetween, reaction forces at the time of clamping the set of the sheets between the head unit 3 and the anvil unit 4, described later, can be received equally to each other, so that a stable clamp force can be obtained.

Next, a structure and a swinging mechanism of the head unit 3 will be explained with reference to FIG. 1 and FIG. 3. In the head unit 3, a head housing 24 is attached to the box frame 7 described above, and a head 25 is supported at the head housing 24 to be able to ascend and descend. Incidentally, a staple needle band cartridge is freely removably attached to the head 25. In long holes 27 bored in both sides of the head housing 24, an axis pin, not shown, of the head 25 is guided to slide freely, and a cam mechanism is engaged with the axis pin.

The cam mechanism is formed of left and right arm sections 29 which engage the axis pin, and transmission gears 30 for transmitting the swinging movement to the arm sections 29. Substantially central portions of the arm sections 29 are axially rotatably supported by the box frame 7, and oval cam holes 31 are formed at rear sides of the arm sections 29. A center portion of the transmission gear 30 is axially movably supported by the box frame 7, and also, a pin 32 projects at an outer peripheral portion of the transmission gear 30, in which the pin 32 inscribes the cam hole 31. Therefore, when the transmission gears 30 rotate, the pins 32 move along inner peripheral edges of the cam holes 31, and by swinging the arms 29, the head 25 ascends or descends.

The transmission gears 30 are driven by receiving a driving force from the guide shaft 33 which is also used as a rotation driving shaft. The guide shaft 33 is fitted with the driving gears 34 at both sides of the box frame 7, and since the driving gears 34 engage the transmission gears 30, the driving force is transmitted to the transmission gears 30 by rotating the guide shaft 33.

Next, a structure and a swinging mechanism of the anvil unit 4 will be explained. As shown in FIG. 1, FIG. 3, and FIG. 4, a rear end of the movable frame 40 is axially rotatably supported by the fixed frame 11, which is slidably attached to the front and rear guide shafts 10 and 43, and a front end of the movable frame 40 is urged by a coil spring 57. The anvil unit 4 is attached swingably with respect to the movable frame 40 described above. Incidentally, since a center of rotation of the movable frame 40 is obtained by engagement of the collars 42 and 44 disposed at the rear ends of the fixed frame 11 and the movable frame 40, the rotating posture of the movable frame 40 with respect to the fixed frame 11 is always stable.

As shown in FIG. 4, the anvil unit 4 includes an anvil main body 45 in a box structure, and a patch or support plate 47 pressed against a side of the anvil main body 45 by the pair of left and right coil springs 46, and a clincher swinging section 48 and a clincher supporting frame 49 are stored in the anvil main body 45. On the left and right side surfaces of the anvil main body 45, a pair of through holes 50 and 51 is bored in the front and rear sides thereof, and a supporting shaft 52 projecting from a side surface of the clincher supporting frame 49 passes through the through hole 50 at the front side to be slidably fitted with long holes 53 formed in the side surfaces of the movable frame 40. Also, a supporting shaft 54 projecting from the side surfaces of the clincher swinging section 48 passes through holes 55 bored in the clincher supporting frame 49 and the through holes 51 bored in the anvil main body 45, and the supporting shaft 54 is supported in supporting holes 56 in a shape of an inverted triangle formed in the side surfaces of the movable frame 40.

As described above, by supporting the supporting shafts 52 and 54 by the movable frame 40, there is formed the anvil unit 4 in which the clincher swinging section 48 and the clincher supporting frame 49 are built in the anvil main body 45, and at the same time, the anvil unit 4 is capable of moving vertically or in the up and down directions with respect to the movable frame 40 within ranges of the long holes 53 and the supporting holes 56. Incidentally, tapered projecting sections 58 extending upwardly are also formed at the left and right frame members of the clincher supporting frame 49, and the projecting sections 58 are inserted in guide holes 59 bored in an upper surface of the movable frame 40. Each of the guide holes 59 is formed to have a width wider than that of the projecting section 58, and it allows to swingably move the anvil unit 4 within a range in which the projecting sections 58 move in the guide holes 59.

Figure 7:
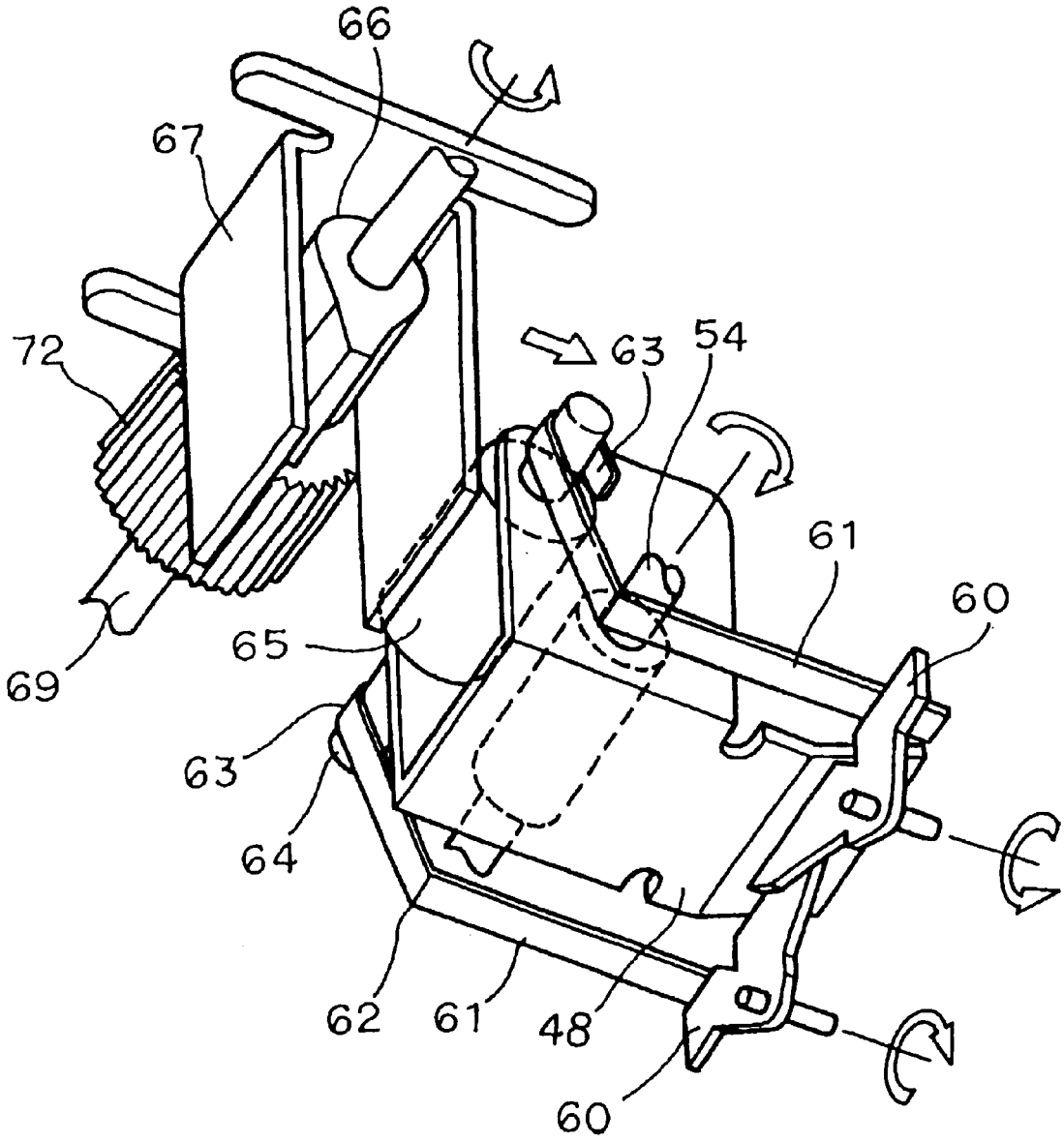
FIG. 7 is a perspective view showing a swing mechanism of a clincher section.

On the front side of the clincher swinging section 48, a pair of left and right clincher sections 60 is rotatably supported, and also, distal ends of substantially L-shaped leaf springs 61 are engaged outside the end portions of the clincher sections 60. In the leaf springs 61, as shown in FIG. 7, central bent portions 62 engage the supporting shaft 54, and U-shaped hook portions 63 engage a roller shaft 64, to thereby keep a posture of the clincher swinging section 48. Also, a substantially U-shaped pressing member 67, which slidably moves by a rotation of a clincher driving cam 66, abuts against a roller section 65 provided at a center of the roller shaft 64. When the roller section 65 is pushed forwardly by the pressing member 67, the clincher swinging section 48 swings around the supporting shaft 54 while resisting spring pressures of the leaf springs 61, and the distal end of the clincher swinging section 48 push down the clincher sections 60 to rotate the same. By driving the needle, distal ends of the needle inserted into the anvil main body 45 from slits 45*a* and 49*a* formed in respective lower surfaces of the anvil main body 45 and the clincher supporting frame 49 are bent inwardly by the rotating clincher sections 60. Incidentally, a rotating shaft 69 of the clincher driving cam 66 is rotatably supported at the side portions of the movable frame 40.

Figure 8:
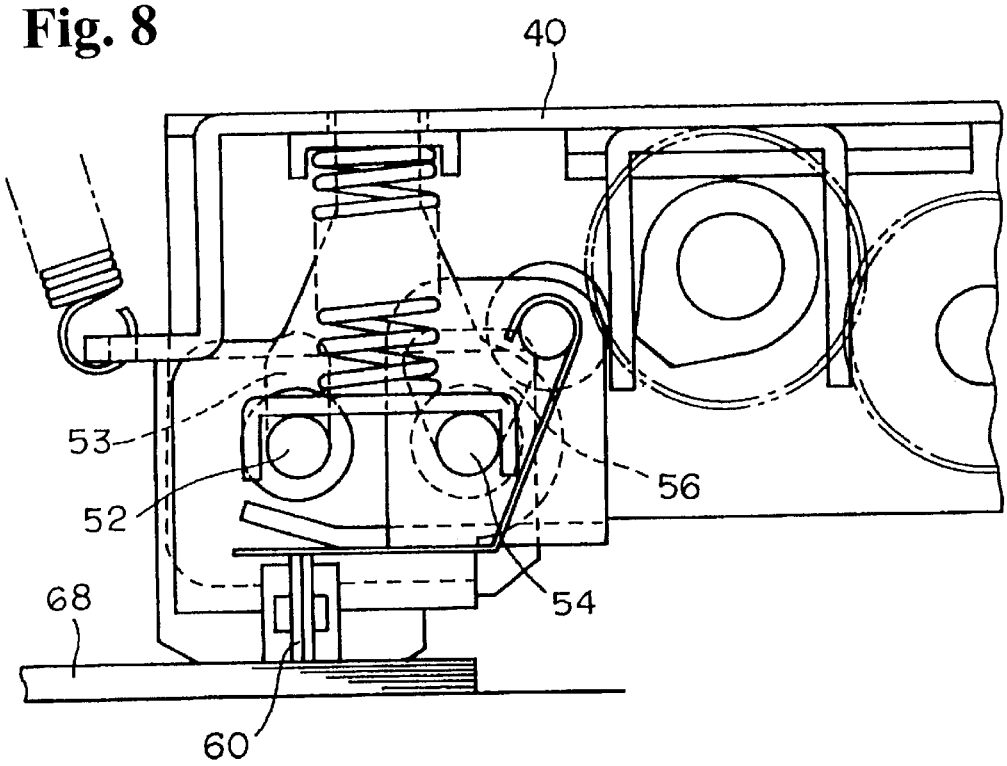
FIG. 8 is a side view of the anvil unit showing a vertical position of an anvil main body with respect to a movable frame in case a thin set of sheets is clamped.
Figure 9:
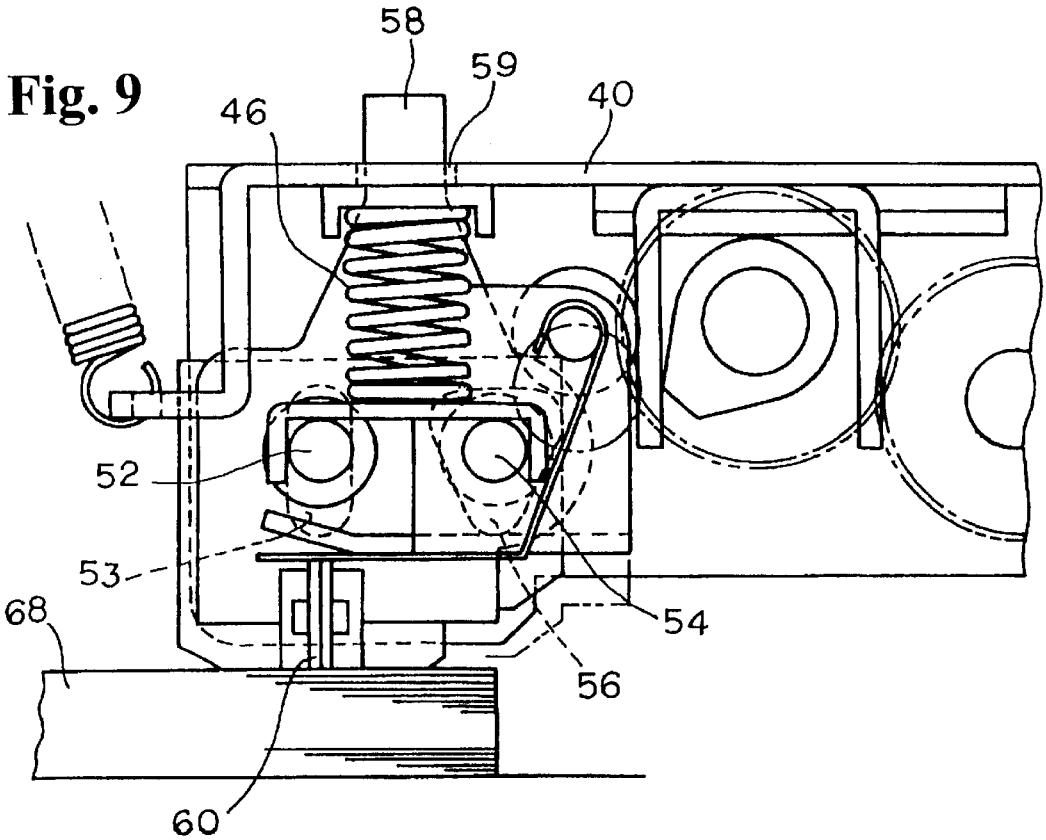
FIG. 9 is a side view of the anvil unit showing the vertical position of the anvil main body with respect to the movable frame in case a thick set of sheets is clamped.

Normally, the anvil unit 4 is urged toward a lower side by the coil springs 46 compressed between the movable frame 40 and the anvil unit 4. However, as shown in FIG. 8 and FIG. 9, in accordance with a thickness of a set of the sheets 68 at the time of clamping, a rotating amount varies, so that an amount of pushing up the anvil unit 4 in case of stapling varies. Namely, as shown in FIG. 8, in case a set of the sheets 68 is thin, since the amount of rotating the anvil unit 4 at the time of clamping the set of the sheets is large, an amount of pushing up the anvil unit 4 at the time of driving the needle by the head unit 3 is small, so that the set of the sheets 68 is stapled in the condition that the supporting shafts 52 and 54 of the anvil unit 4 descend to the vicinity of lower end portions of the long holes 53 and the supporting holes 56 in the side portions of the movable frame 40.

On the other hand, as shown in FIG. 9, in case the set of the sheets 68 is thick, since the amount of rotating the anvil unit 4 at the time of clamping is decreased as compared to the former case, the amount of pushing up the anvil main body 45 in case of stapling is increased for the increased thickness, and the anvil main body 45 is moved to the side of the movable frame 40 by resisting the spring forces of the coil springs 46, so that the supporting shafts 52 and 54 move inside the long holes 53 and the supporting holes 56. In this case, the supporting shaft 54 is movable inside the supporting holes 56, and the projecting sections 58 at the distal ends of the clincher supporting frame 49 are movable in the guide holes 59 formed in the upper surface of the movable frame 40. Therefore, the anvil unit 4 swings around the supporting shaft 52, and while the anvil unit 4 changes its posture such that the lower surface of the anvil main body 45 follows the sheet surface, the distal ends of the driven needle are guided to the slit 45*a* of the anvil main body 45. As described above, the supporting shaft 54 can move freely at a certain degree in the supporting holes 56, and there is a space between the projecting section 58 and the guide holes 59. Thus, the anvil main body 45 can swing around the supporting shaft 52, resulting in having no difference in the clinch mechanism due to the difference in the thickness of the set of the sheets 68.

Also, since the anvil unit 4 is pressed and supported by the pair of the left and right coil springs 46, the anvil unit 4 can swing in the right and left directions. Therefore, since a parallelism between the guide shafts 6 and 10 is not obtained between the side plates 1*a* and 1*b* at both sides, a height of the set of the sheets 68 in the sheet width direction varies at the right and left sides of the anvil unit 4. In case the head unit 3 and the anvil unit 4 are not parallel to each other when the set of the sheets 68 is clamped, the anvil unit 4 swings in the sheet width direction, to thereby keep a parallelism between the anvil unit 4 and the head unit 3, so that the staple operation can be securely carried out.

Figure 10:
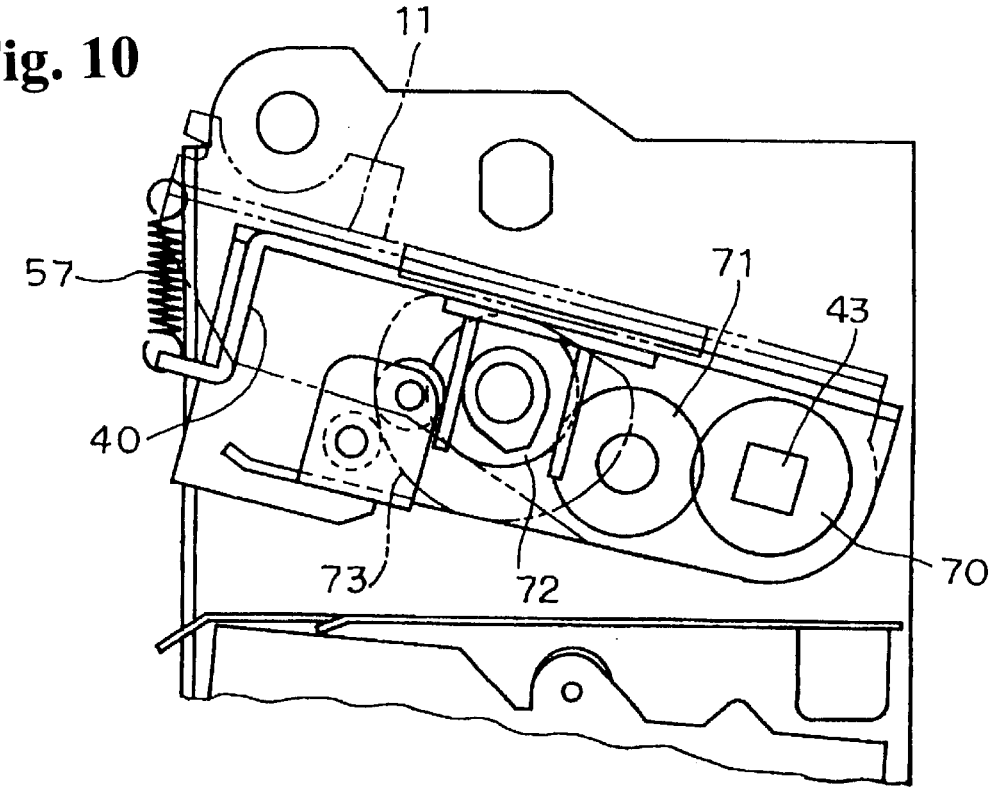
FIG. 10 is a side view showing a posture of the anvil unit before the anvil unit swings.
Figure 11:
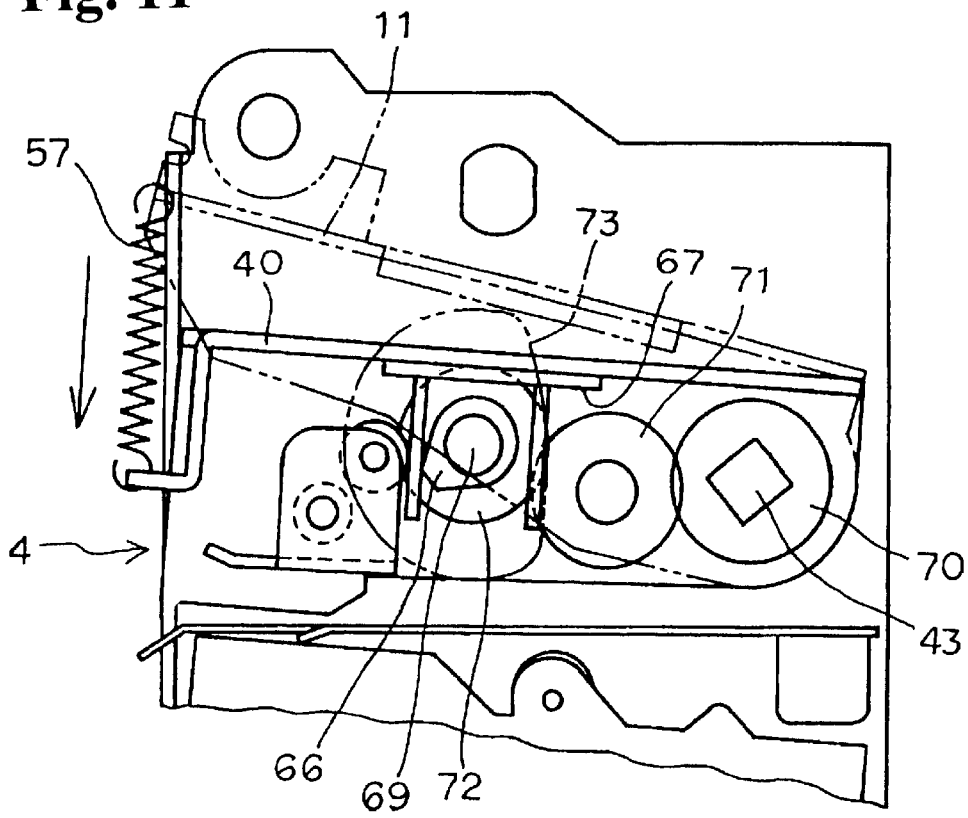
FIG. 11 is a side view showing a posture of the anvil unit in case the anvil unit swings to clamp the set of the sheets.
Figure 12:
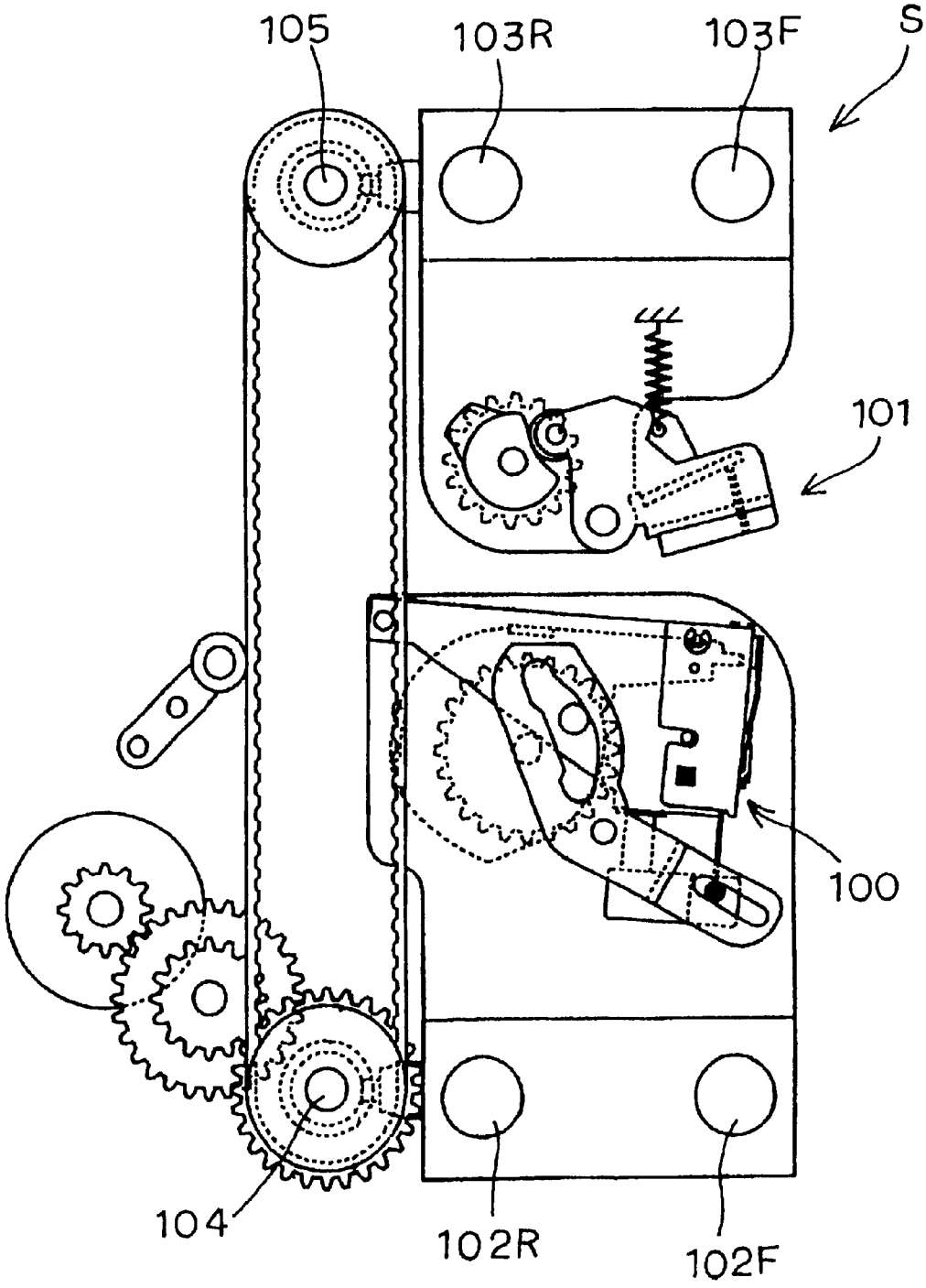
Fig. 12 Prior Art
FIG. 12 is a side view of a conventional stapling device, showing an arrangement of guide shafts and moving shafts.

The anvil unit 4 formed of the aforementioned structure rotates by receiving the driving force from the guide shaft 43 having the rectangular shape in section. As shown in FIG. 3, FIG. 10, and FIG. 11, the driving gear 70 is fitted with the guide shaft 43 at a substantially central portion of the movable frame 40. Also, the driving gear 70 engages a driven gear 72, which is formed on the same rotational shaft 69 as the clincher driving cam 66, through a transmission gear 71. At both ends of the rotational shaft 69, semicircular eccentric cams 73 are disposed at both left and right sides in order to swingably move the anvil unit 4 in a narrow space between the fixed frame 11 and the movable frame 40. The eccentric cam 73 makes the fixed frame 11 as a cam follower, and as shown in FIG. 11, when the eccentric cam 73 rotates on a surface of the fixed frame 11, the movable frame 40 is allowed to swing with respect to the fixed frame 11. In this embodiment, the eccentric cams 73 are attached to the movable frame 40 rotating integrally with the anvil unit 4, and held between the fixed frame 11 and the movable frame 40, respectively, so that the rotating mechanism can be made compact.

FIG. 10 and FIG. 11 show the swinging movements of the anvil unit 4 by the eccentric cams 73. FIG. 10 shows a stand-by condition of the anvil unit 4, in which the movable frame 40 is urged to the side of the fixed frame 11 by the coil spring 57. FIG. 11 shows a clamped condition of the sheets, in which when the guide shaft 43 rotates, the driving gear 70 rotates accordingly, and the rotating force is transmitted to the driven gear 72 through the transmission gear 71. By the rotation of the driven gear 72, the eccentric cams 73 rotate, and by making the fixed frame 11 as the cam follower, the movable frame 40 swings to be pushed down against the spring force of the coil spring 57. The anvil unit 4 is pushed down together with the movable frame 40, and the lower surface of the anvil unit 4 clamps the set of the sheets. On the other hand, the clincher driving cam 66 rotates together with the rotation of the eccentric cams 73 to push out the pressing member 67, 50 that the clincher section 60 swings, to thereby complete the operation of bending the needle.

Incidentally, although the eccentric cams 73 are arranged to be stored in the movable frame 40 in the above explanation, it is possible to store the eccentric cams 73 in the fixed frame side.

In the guide shaft 33 at a rear side of the head unit 3, one distal end of the guide shaft 33 projects outside the side plate 1*a*, and a driving transmission gear 35 is attached to the projected end portion of the guide shaft 33. Then, a driving force from a driving motor is transmitted to the guide shaft 33 through the driving transmission gear 35. Also, the other end of the guide shaft 33 projects outside the side plate 1*b* at the other side, and a driven gear 75 is attached to the projected end portion of the guide shaft 33. On the other hand, the end portion of the guide shaft 43 in the rear side of the anvil unit 4 projects outside the side plate 1*b*, and a driven gear 76 is attached to the projected end portion of the guide shaft 43. Between the transmission gear 75 and the driven gear 76, an endless gear belt 77 is wound, so that a rotation of the guide shaft 33 in the head unit 3 can be transmitted to the guide shaft 43 in the anvil unit 4 through the gear belt 77.

As described above, in this embodiment, one guide shaft 33 of the head unit 3 is also used as the driving shaft of the head 25, and one guide shaft 43 of the anvil unit 4 is also used as a rotation driving shaft of the anvil unit 4, so that the entire device can be made small and light-weighted as compared to the case in which the shafts are additionally provided.

Next, the stapling operation of the stapler S structured as described above will be explained. Between the head unit 3 and the anvil unit 4, there is disposed a sheet guide plate 78 in a flat plate form extending between the left and right side plates 1*a* and 1*b*, and at both left and right sides of the anvil unit 4, path guide members 79 in a rod form extend between the front and rear guide shafts 10 and 43. The path guide members 79 are disposed to be opposed to the sheet guide plate 78. A distal end of the path guide member 79 is fixed to one end of a thin coil spring 80 wound around the guide shaft 10, and a rear end of the path guide member 79 is loosely fitted with the guide shaft 43. Thus, the path guide members 79 can move in accordance with the sliding movement of the anvil unit 4 along the guide shafts 10 and 43. A sheet transferred between the head unit 3 and the anvil unit 4 is stacked at a predetermined position while being guided between the sheet guide plate 78 and the path guide members 79, to thereby form a set of the sheets. Even if the sheet has a curling tendency, since the curl of the sheet can be pressed or held by the path guide members 79, the stapling process can be securely carried out.

When the motor 16 is driven based on a control signal, the screw rods 14 and 15 are rotated, and the head unit 3 and the anvil unit 4 are guided to predetermined positions. In this case, the head unit 3 and the anvil unit 4 synchronously move together in the same direction, and stop at the same positions. Next, when the guide shafts 33 and 43 are rotated, the head unit 3 and the anvil unit 4 swing synchronously. At this time, at the side of the head unit 3, by the movement of the arm sections 29 having the cam holes 31, only the head 25 swings toward the side of the anvil unit 4, and the head housing 24 does not swing to keep the condition as it is. On the other hand, at the side of the anvil unit 4, by the rotations of the eccentric cams 73, the movable frame 40 swings, and by clamping the set of the sheets between the head 25 and the movable frame 40, the staple needle is driven into the set of the sheets. Also, by rotating the clincher driving cam 66 together with the eccentric cams 73, the clincher section 60 is actuated, and the distal ends of the staple needle passing through the set of the sheets are inwardly bent, to thereby bind the set of the sheets.

In this case, as described above, in accordance with the thickness of the set of the sheets, the anvil unit 4 swings, and bending the needle ends is carried out at the appropriate anvil position. When the aforementioned cams make one rotation and the head 25 and the anvil unit 4 are returned to the original positions, the rotations of the guide shafts 33 and 43 are stopped, and the screw rods 14 and 15 are rotated again to move the head unit 3 and the anvil unit 4 to predetermined positions in the sheet width direction, to bind the set of the sheets as described above.

Incidentally, in the present invention, a rotating mechanism for the movable frame 40 is not limited to the eccentric cams 73 in the aforementioned embodiment, and for example, the movable frame 40 can be rotated by a mechanism used in the ascending and descending movements for the head 25. Also, in the above embodiment, the anvil unit 4 swings to clamp the set of the sheets between the anvil unit 4 and the head unit 3 at the predetermined position, but it is needless to say that the head unit 3 can swing. It is also needless to say that both the head unit 3 and the anvil unit 4 can swing respectively.

As explained above, according to the present invention, in case the needle driving unit and the needle bending unit are moved in the sheet width direction, these units can be moved stably and smoothly, and the guide shafts and the moving shafts in a mechanism for moving are rationally arranged to thereby provide a miniaturized stapling device.

Also, a space for the moving mechanism for moving the needle bending means or the like in the sheet thickness direction is reduced as small as possible, to thereby miniaturize the entire device, and furthermore, the set of the sheets can be stapled securely at the stapling position.

While the invention has been explained with reference to the specific embodiments of the invention, the explanation is illustrative and the invention is limited only by the appended claims.

What is claimed is:

1. A stapling device, comprising:

a needle driving unit for driving a needle into a set of sheets, a bending unit for bending the needle driven into the set of the sheets, said bending unit being located at a side opposite to the needle driving unit relative to the set of sheets to be bound, two pairs of front and rear guide shafts for supporting the needle driving unit and the bending unit and guiding the respective units to move in a sheet width direction, moving shafts for moving the needle driving unit and the bending unit along the guide shafts in the sheet width direction, each of the moving shafts being disposed between the front and rear guide shafts in each pair, and a sheet path guide member extending between the front and rear guide shafts in one of the pairs to be disposed between the needle driving unit and the bending unit, said sheet path guide member having a spring member wound around one of the guide shafts and being capable of expanding and contracting in accordance with movements of the needle driving unit and the bending unit along the guide shafts to allow the sheet path guide member to move in an axial direction of the guide shafts.

2. A stapling device according to claim 1, wherein said two pairs of the front and rear guide shafts include a pair of said front and rear guide shafts for supporting the needle driving unit and guiding the same to move in the sheet width direction, one of the front and rear guide shafts operating as a driving shaft for allowing the needle driving unit to perform a needle driving operation, and a pair of said front and rear guide shafts for supporting the bending unit and guiding the same to move in the sheet width direction, one of the front and rear guide shafts operating as a driving shaft for allowing the bending unit to perform a bending operation.

3. A stapling device according to claim 2, further comprising connecting means for connecting the driving shafts for the needle driving unit and the bending unit together, and single driving means connected to one of the driving shafts for the needle driving unit and the bending unit so that the needle driving unit and the bending unit synchronously perform a stapling operation by the single driving means through the connecting means.

4. A stapling device according to claim 1, wherein said guide shafts are disposed in the needle driving unit and the bending unit, respectively, one of the guide shafts disposed in the needle driving unit being used to perform a needle driving operation and one of the guide shafts disposed in the bending unit being used to perform a bending operation.

5. A stapling according to claim 2, wherein the guide shafts and the moving shafts are disposed in the needle driving unit and the bending unit, respectively, and are disposed opposite to each other.

6. A stapling device according to claim 5, further comprising a common driving source connected to the moving shafts of the needle driving unit and the bending unit for moving the units in the sheet width direction.

7. A stapling device according to claim 2, wherein said driving shaft for the needle driving unit includes a pair of driving gears disposed on two sides of the needle driving unit, said needle driving unit being operated to drive the needle by the driving shaft through the driving gears.

8. A stapling device according to claim 3, wherein said connecting means is a belt for connecting the driving shafts for the needle driving unit and the bending unit together, and said single driving means includes a driving transmission gear connected to one of the driving shafts and a driving motor connected to the driving transmission gear.

* * * * *